US005875767A

United States Patent [19]

Bock et al.

[11] Patent Number: 5,875,767

[45] Date of Patent: Mar. 2, 1999

[54] IGNITION COIL ARRANGEMENT FOR INTERNAL COMBUSTION ENGINES

[75] Inventors: Norbert Bock, Oberstaufen; Lothar Detels, Burgberg; Nikolaus Hautmann, Waltenhofen, all of Germany

[73] Assignee: Robert Bosch GmbH, Stuttgart, Germany

[21] Appl. No.: 916,974

[22] Filed: Aug. 14, 1997

[30] Foreign Application Priority Data

Aug. 27, 1996 [DE] Germany ..... 296 14 872 U

[51] Int. Cl.[6] ..... F02P 13/00

[52] U.S. Cl. ..... 123/635; 123/634; 123/143 C; 336/67

[58] Field of Search ..... 123/634, 635, 123/143 C; 336/67

[56] References Cited

U.S. PATENT DOCUMENTS 5,146,906 9/1992 Agatsuma ..... 123/635
5,535,726 7/1996 Wilmot et al. ..... 123/635
5,537,983 7/1996 Nakajima ..... 123/635
5,618,193 4/1997 Nakajima et al. ..... 123/647

FOREIGN PATENT DOCUMENTS 41 32 851 4/1992 Germany .

*Primary Examiner*—Erick R. Solis
*Attorney, Agent, or Firm*—Kenyon & Kenyon

[57] ABSTRACT

An ignition coil arrangement for internal combustion engines is embodied so that a housing of an individual ignition coil can be produced economically, and attachment of the ignition coil can be accomplished easily. The ignition coil is configured as a rod-type ignition coil, and the housing is of basically cylindrical shape, since a holding element for fastening the ignition coil is configured in the high-voltage output of the ignition coil itself. Assembly and retention of the ignition coil are accomplished by a direct threaded connection on the high-voltage terminal of a spark plug. For rotational immobilization, a primary terminal of the ignition coil is coupled to a fastenable mating plug as a joining member. The ignition coil arrangement is preferably used in motor vehicles.

7 Claims, 1 Drawing Sheet

IGNITION COIL ARRANGEMENT FOR INTERNAL COMBUSTION ENGINES

BACKGROUND INFORMATION

German Patent Application No. DE 41 32 851 A1 describes an ignition coil, having a housing of basically cylindrical shape, of an ignition coil unit. To retain the ignition coil on a cylinder head of an internal combustion engine, the housing has a radially distanced plate-shaped holding element having an attachment hole.

Disadvantageously, the housing as a result is complex in terms of production engineering, and because of the use of a separate attachment element which must be guided through the attachment hole and anchored in the cylinder head, the retainer of the ignition coil is cost-intensive.

SUMMARY OF THE INVENTION

The ignition coil arrangement for internal combustion engines according to the present invention has the advantage that the aforementioned shortcomings are eliminated to a satisfactory degree.

Each of the ignition coils is configured so that a high-voltage output of the ignition coil is configured as a holding element for the ignition coil, the result being that a housing with an easily manufactured basically cylindrical shape can be used for the ignition coil.

Retention is accomplished, in a manner favorable in terms of production engineering, by directly threading the holding element onto a high-voltage terminal (present in any case) of a spark plug, the overall result being that economical production of the ignition coil arrangement is made possible.

DETAILED DESCRIPTION

Figure 1:
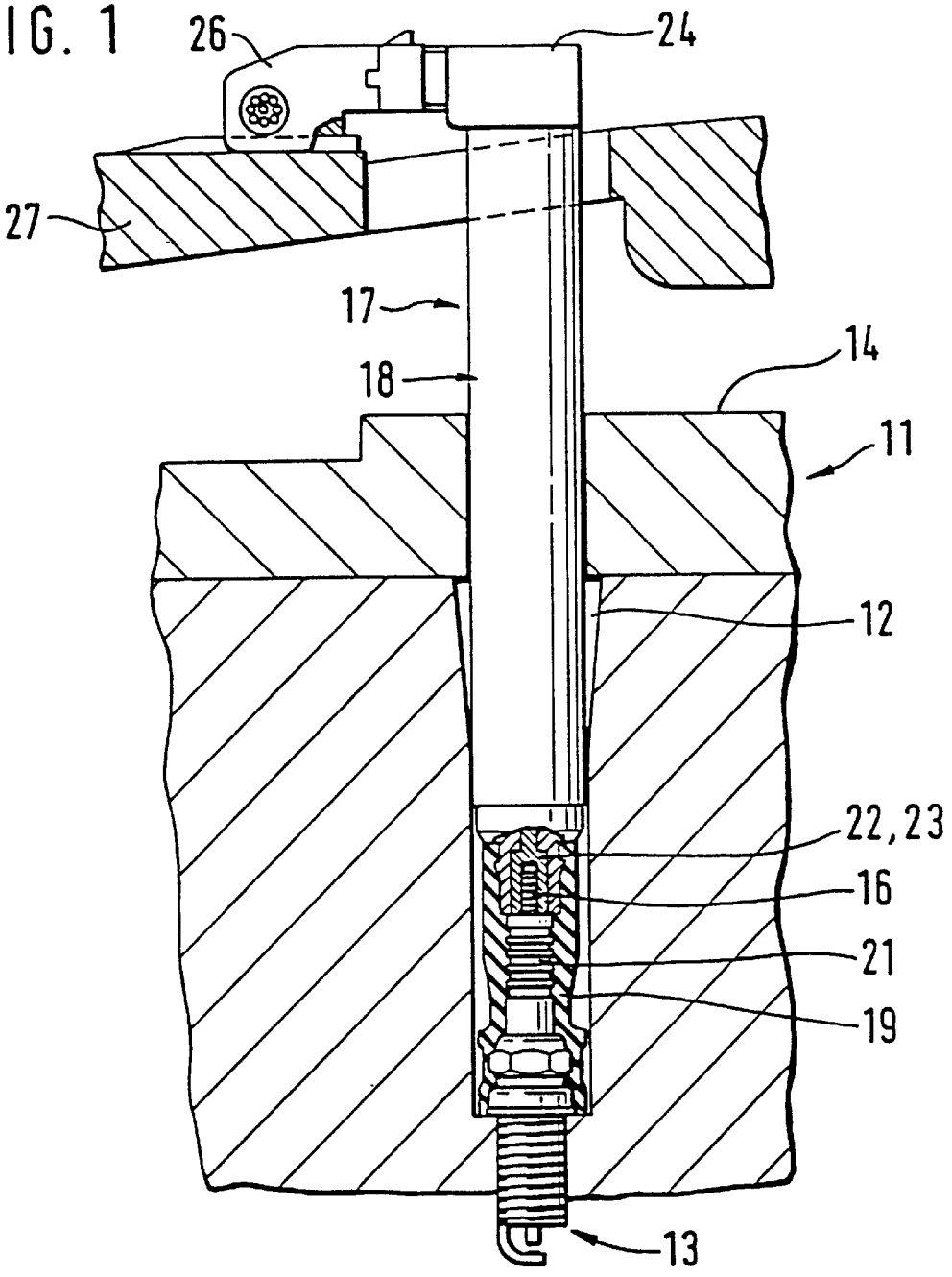
FIG. 1 shows a sectional view of the ignition coil arrangement as a whole.
Figure 2:
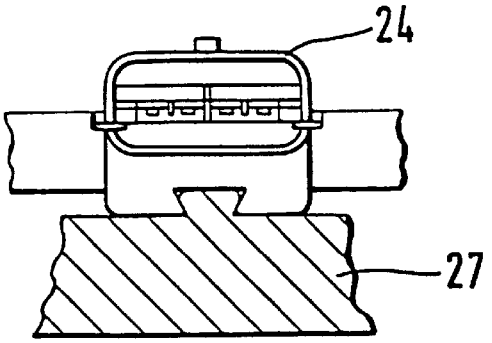
FIG. 2 shows an attachment detail in a view rotated 90 degrees.

FIGS. 1 and 2 show portions of an ignition coil arrangement for internal combustion engines, as used for multicylinder internal combustion engines.

In FIG. 1, a duct 12 in the form of a hole, in which a spark plug 13 is inserted below the level of a top surface 14 of cylinder head 11, and fastened, is present in a cylinder head 11 of an internal combustion engine. A portion of an ignition coil 17 is inserted into the open portion of duct 12, in order to make contact with a high-voltage terminal 16 of spark plug 13, in such a way that the longitudinal axes of ignition coil 17 and spark plug 13 are coincident.

In this context, the ignition coil (not shown in further detail), in the form of a rod-type ignition coil with a housing 18 of basically cylindrical shape, extends with a sheath element 19 made of elastic material over a neck 21 of spark plug 13. A high-voltage output 22 of ignition coil 17, which is configured as a threaded bushing recessed inside sheath element 19, comes into contact with high-voltage terminal 16 of spark plug 13.

To provide continuous electrical contact and secure positioning of ignition coil 17, the latter is threaded, with high-voltage output 22 which serves as a holding element 23, onto high-voltage terminal 16 of spark plug 13. To secure ignition coil 17 against rotation, a primary terminal 24 of ignition coil 17, which is attached outside duct 12 at the free end of ignition coil 17 and is aligned radially with respect to housing 18 and the threading direction along the longitudinal axis of housing 18, is then coupled to a joining means 26 in the form of a mating plug. This requires that the threaded connection of ignition coil 17 onto spark plug 13 be changed, in the context of the last turn, in such a way that primary terminal 23 aligns with joining means 26, which can be slid onto a cylinder head cover 27, which covers cylinder head 11, by means of a dovetail guide as shown in FIG. 2.

Alternatively, joining means 26 could also itself be mounted slidingly on cylinder head 11, or ignition coil 17 could be rotationally immobilized, for example by means of a stationary cover (not depicted) or a rigid contact module having multiple mating plugs for the entire ignition coil arrangement.

An ignition coil arrangement embodied in this fashion has ignition coils 17 which each have an easily manufactured housing 18, since a laterally distanced holding element 23 does not need to be configured on it. Assembly and retention of ignition coils 17 are accomplished in each case by directly threading holding element 23 onto high-voltage terminal 16 of spark plug 13; and rotational immobilization is accomplished, in a manner favorable in terms of production engineering, by means of primary terminal 24 (present in any case) of ignition coil 17.

What is claimed is:

1. An ignition coil arrangement for an internal combustion engine, at least one spark plug having a high-voltage terminal being fastened in the engine, comprising:

at least one ignition coil containing a primary terminal and a high-voltage output for connection to the high-voltage terminal of the spark plug, the high-voltage output containing at least one holding element for attachment onto the engine, the ignition coil being joined via the holding element to the high-voltage terminal of the spark plug via a threaded connection.

2. The ignition coil arrangement according to claim 1, further comprising a housing coupled to the holding element.

3. The ignition coil arrangement according to claim 1, wherein:

the holding element is configured as a threaded bushing;

the high-voltage terminal of the spark plug is configured as a threaded stud; and the holding element is threaded directly onto the high-voltage terminal of the spark plug.

4. The ignition coil arrangement according to claim 3, further comprising a joining member fastened on the engine and joined to the primary terminal.

5. The ignition coil arrangement according to claim 4, wherein the joining member is mounted, in a radially slidable fashion with respect to a direction in which the holding element is threaded onto the high-voltage terminal, on at least one of a cylinder head and a cylinder head cover of the engine, the direction extending along longitudinal axes of the ignition coil and the spark plug.

6. The ignition coil arrangement according to claim 5, where in the joining member is guided, for radial sliding, in a dovetail joint.

7. The ignition coil arrangement according to claim 1, wherein the ignition coil includes a cylindrically-shaped housing, and the ignition coil is configured as a rod-type ignition coil for direct mounting on a duct, receiving the spark plug, of a cylinder head of the engine.

* * * * *